US008833616B2

(12) United States Patent
Lin

(10) Patent No.: US 8,833,616 B2
(45) Date of Patent: Sep. 16, 2014

(54) FLOW CONTROL DEVICE

(76) Inventor: Jih-Liang Lin, Hualien County (TW)

( * ) Notice: Subject to any disclaimer, the term of this patent is extended or adjusted under 35 U.S.C. 154(b) by 49 days.

(21) Appl. No.: 13/529,870

(22) Filed: Jun. 21, 2012

(65) Prior Publication Data

US 2013/0001259 A1 Jan. 3, 2013

(30) Foreign Application Priority Data

Jun. 29, 2011 (TW) ..... 100211859 U

(51) Int. Cl.
*B67D 3/00* (2006.01)
*B65D 47/26* (2006.01)
*B65D 47/08* (2006.01)

(52) U.S. Cl.
CPC ..... *B65D 47/266* (2013.01); *B65D 47/0871* (2013.01); *B65D 47/268* (2013.01)
USPC ..... 222/507; 222/548; 222/556; 222/558; 222/562; 251/315.06; 251/352

(58) Field of Classification Search
USPC ..... 222/544–545, 548, 507, 556, 558, 562; 251/315.01, 315.06, 315.14, 286–287, 251/352
See application file for complete search history.

(56) References Cited

U.S. PATENT DOCUMENTS 1,691,811 A * 11/1928 Elmer ..... 222/507
1,882,697 A * 10/1932 Aldridge ..... 222/545
2,030,696 A * 2/1936 Forster ..... 222/542
2,032,776 A * 3/1936 Van Ness ..... 222/541.6
2,120,510 A * 6/1938 Rhoads ..... 222/507
2,209,050 A * 7/1940 Church ..... 222/556
2,779,519 A * 1/1957 Rossetti ..... 222/507
3,703,249 A * 11/1972 Middleton ..... 222/507
3,703,250 A * 11/1972 Middleton ..... 222/507
4,946,079 A * 8/1990 Campbell ..... 222/484
6,139,802 A * 10/2000 Niermann et al. ..... 422/568
6,705,482 B2 * 3/2004 Savitz et al. ..... 220/254.3
7,165,568 B2 * 1/2007 Kessell et al. ..... 137/68.3
7,275,665 B2 * 10/2007 Young ..... 222/525
7,762,437 B2 * 7/2010 Holcomb et al. ..... 222/469
7,988,013 B2 8/2011 Lin
2007/0045313 A1 * 3/2007 Holcomb et al. ..... 220/212.5

* cited by examiner

*Primary Examiner* — Frederick C Nicolas
(74) *Attorney, Agent, or Firm* — Chun-Ming Shih

(57) ABSTRACT

A flow control device is provided. The flow control device includes a body including a containing space, a discharge opening fluidly communicating with the containing space, and a pair of side holes configured to be in radial correspondence with each other; a flow control member installed in the containing space and including a pair of engaging portions corresponding to the side holes; an adapter including an adapting part coupled to the body and a hitching part for being coupled to an external container; a washer coupled to the adapting part and inserted into the body for installing the flow control member in the containing space; and a handle including an operational part, and a pair of engaging ends coupled to the operational part and engaged with the engaging portions through the side holes.

13 Claims, 14 Drawing Sheets

FLOW CONTROL DEVICE

CROSS REFERENCE TO RELATED APPLICATIONS

The application claims the benefit of Taiwan Utility Model Patent Application No. 100211859, filed on Jun. 29, 2011, at the Taiwan Intellectual Property Office, the disclosures of which are incorporated herein in their entirety by reference.

FIELD OF THE INVENTION

The present invention generally relates to a liquid flow control device applicable to various containers having an opening, and in particular to an improved flow control device that comprises a ball valve having a flow passage and a hood mounted to the opening of the container.

BACKGROUND OF THE INVENTION

The common container in the market for containing the fluid drink (such as the water, fruit juice, carbonated beverage, and alcoholic beverage), e.g. the PET bottle, glass bottle or vacuum flask, is provided with an opening or an outlet tube for serving as a flow passage for the fluid drink to be poured out therethrough. Usually, the mouth of the container is closed by a cap or a faucet, but the conventional cap is mounted to the container mouth by means of a threading engagement. Although better closing can be realized thereby, the threading engagement demands both hands at the same time for smoothing the opening/closing operation. Thus, for a user who cannot spare both of his hands when riding a bicycle, driving a car, or carrying an object, it often makes lots of inconvenience.

In addition, a faucet always serves as the control device for a discharge opening of a flow passage. A conventional faucet is structured so that an external handle is operable to drive a water block member or a ball valve contained inside the faucet and to control discharge of the flow thereby. However, the conventional faucet has numerous components/parts, and the assembling thereof is too complicated so that it is not suitable for use in the opening of the aforementioned container. This inevitably results in a waste of source.

In view of the aforementioned disadvantages, the inventor of the present invention has proposed a design of "flow control device" in the U.S. Pat. No. 7,988,013 to solve those problems. As illustrated in FIG. 8, the flow control device mainly includes a hood 10, a ball valve 20, a sealing ring 30, and a handle 40. The hood 10 has a discharge opening 12 thereon, and is fixed to the mouth of the bottle via the thread. The ball valve 20 has a flow passage 21, and is movably mounted in the internal receiving space 14 of the hood 10 and braked by a sealing ring 12 so that the ball valve 20 and the handle 40, which is located outside of the hood 10, are coupled together and thus movable in unison with each other. As a result, the user can control the rotation of the ball valve 20 by operating the handle 40 to switch the communication state between the flow passage 21 and the discharge opening so that the function of controlling the discharge state is achieved.

Although the aforementioned flow control device in the U.S. Pat. No. 7,988,013 can effectively solve the disadvantages of the conventional caps, it still has the disadvantages of failing to prevent the discharge opening from being contaminated by the dirt and not easy for a user to drink directly with his mouth. Therefore, the inventor of the present invention proposes an improved flow control device that is more pollution-proof and more convenient for the user to drink directly with his mouth so as to meet the user's requirements.

SUMMARY OF THE INVENTION

In accordance with an aspect of the present invention, an improved flow control device is provided, which can be operated with a single hand, has a dirt-proof function, and facilitates direct drinking with the mouth.

In accordance with another aspect of the present invention, a flow control device is provided. The flow control device includes a body including a containing space internally formed therein, an installing opening fluidly communicated with the containing space, a discharge opening fluidly communicated with the containing space, an internal thread formed near the installing opening and two side holes corresponding to the containing space and configured to be radial correspondence with each other; a ball valve, installed in the containing space of the body and including an axially penetrated flow passage and two engaging recesses configured to be radial correspondence with each other; a washer component inserted into the body for installing the ball valve in the containing space in a rotatable and sealed way and including a hard snap ring and a soft sealing ring located on a bottom surface of the hard snap ring and inserted into a groove of the inner wall of the body; a hood, pivotally connected to the body for operatively pivoting between a closing position covering the discharge opening of the body and an opening position exposing the discharge opening, wherein the hood includes a stopping rib formed on the outer wall of the hood and an engaging rib formed on the front end of the stopping rib; and a handle, which includes an operational part and two engaging ends, wherein the two engaging ends are respectively engaged with the two engaging recesses of the ball valve through the two holes of the body by which the handle is capable of pivotally rotating about the body between a vertical position and a horizontal position, wherein when the handle pivots to the horizontal position, the ball valve is rotated to align the flow passage with the installing opening and the discharge opening of the body, and form a passage for a flow to pass through the body, and, in the mean while, the hood is allowed to be rotated to the opening position; when the handle pivots to the vertical position, the ball valve is rotated to render the flow passage 90 degrees with respect to the installing opening and the discharge opening of the body so that a flow cannot pass through the body, and, in the mean while, the hood is restricted at the closing position, thereby controlling the discharge state of the flow control device.

The flow control device can further include a bottle mouth adapter, which includes a hitching part capable of being screwed with the jar, and a bottle mouth part capable of being screwed with the internal thread of the body.

The flow control device of the present invention can be provided to be applied to various containers, even the one without external thread on the bottle mouth. The flow control device includes a first body, including a containing space internally formed therein, an installing opening fluidly communicated with the containing space, a discharge opening fluidly communicated with the containing space, an external thread formed on the lower part of the outer sidewall, and two side holes corresponding to the containing space and configured to be radial correspondence with each other; a second body (such as a ferrule) hitched on the outside of the bottle mouth which has no external thread and the second body includes an internal thread formed on the inner wall for matching the external thread of the first body, a necking part formed on the bottom of the second body and having a diameter smaller than the ferrule, and a flexible washer mounted in the ferrule; a ball valve, installed in the containing space of the first body and including an axially penetrated flow passage and two engaging recesses configured to be radial correspondence with each other; a washer component, including a hard snap ring and a soft sealing ring located on a bottom surface of the hard snap ring and inserted into a groove of the inner wall of the first body, for installing the ball valve in the containing space in a rotatable way; a hood, pivotally connected to the first body for operatively pivoting between a closing position covering the discharge opening of the first body and an opening position exposing the discharge opening, wherein the hood includes a stopping rib formed on the outer wall of the hood and an engaging rib formed on the front end of the stopping rib; a handle, which includes an operational part and two engaging ends, wherein the two engaging ends are respectively engaged with the two engaging recesses of the ball valve through the two side holes of the first body by which the handle is capable of pivotally rotating about the first body between a vertical position and a horizontal position, wherein when the handle pivots to the horizontal position, the ball valve is rotated to align the flow passage with the installing opening and the discharge opening of the first body, and form a passage for a flow to pass through the first body, and, in the mean while, the hood is allowed to be rotated to the opening position; when the handle pivots to the vertical position, the ball valve is rotated to render the flow passage 90 degrees with respect to the installing opening and the discharge opening of the first body so that a flow cannot pass through the first body, and, in the mean while, the hood is restricted at the closing position, thereby controlling the discharge state of the flow control device.

The flow control device of the present invention can further include a first body, including a containing space internally formed therein, an installing opening fluidly communicated with the containing space, a discharge opening fluidly communicated with the containing space, an external thread and a plurality of axial rabbet formed on the lower part of the outer sidewall, an inward projecting protrusion edge formed at the installing opening and two side holes corresponding to the containing space and configured to be radial correspondence with each other; a second body (such as a ferrule) hitched on the outside of the bottle mouth which has no external thread and the second body includes an internal thread formed on the inner wall for matching the external thread of the first body, and a necking part formed on the bottom of the second body and having a diameter smaller than the second body, and a flexible washer mounted in the second body; a ball valve, installed in the containing space of the first body and including an axially penetrated flow passage and two engaging recesses configured to be radial correspondence with each other; a washer component, including a hard snap ring and a soft sealing ring located on a bottom surface of the hard snap ring and inserted into a groove of the inner wall of the first body, for installing the ball valve in the containing space in a rotatable way; a hood, pivotally connected to the first body for operatively pivoting between a closing position covering the discharge opening of the first body and an opening position exposing the discharge opening, wherein the hood includes a stopping rib formed on the outer wall of the hood and an engaging rib formed on the front end of the stopping rib; a handle, which includes an operational part and two engaging ends, wherein the two engaging ends are respectively engaged with the two engaging recesses of the ball valve through the two side holes of the first body by which the handle is capable of pivotally rotating about the first body between a vertical position and a horizontal position, wherein when the handle pivots to the horizontal position, the ball valve is rotated to align the flow passage with the installing opening and the discharge opening of the first body, and form a passage for a flow to pass through the first body, and, in the mean while, the hood is allowed to be rotated to the opening position; when the handle pivots to the vertical position, the ball valve is rotated to render the flow passage 90 degrees with respect to the installing opening and the discharge opening of the first body so that a flow cannot pass through the first body, and, in the mean while, the hood is restricted at the closing position, thereby controlling the discharge state of the flow control device.

The above objects and advantages of the present invention will become more readily apparent to those ordinarily skilled in the art after reviewing the following detailed descriptions and accompanying drawings.

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Now the improved flow control device will be specified by referring to the embodiments illustrated in FIG. 1 to FIG. 4.

Figure 1A:
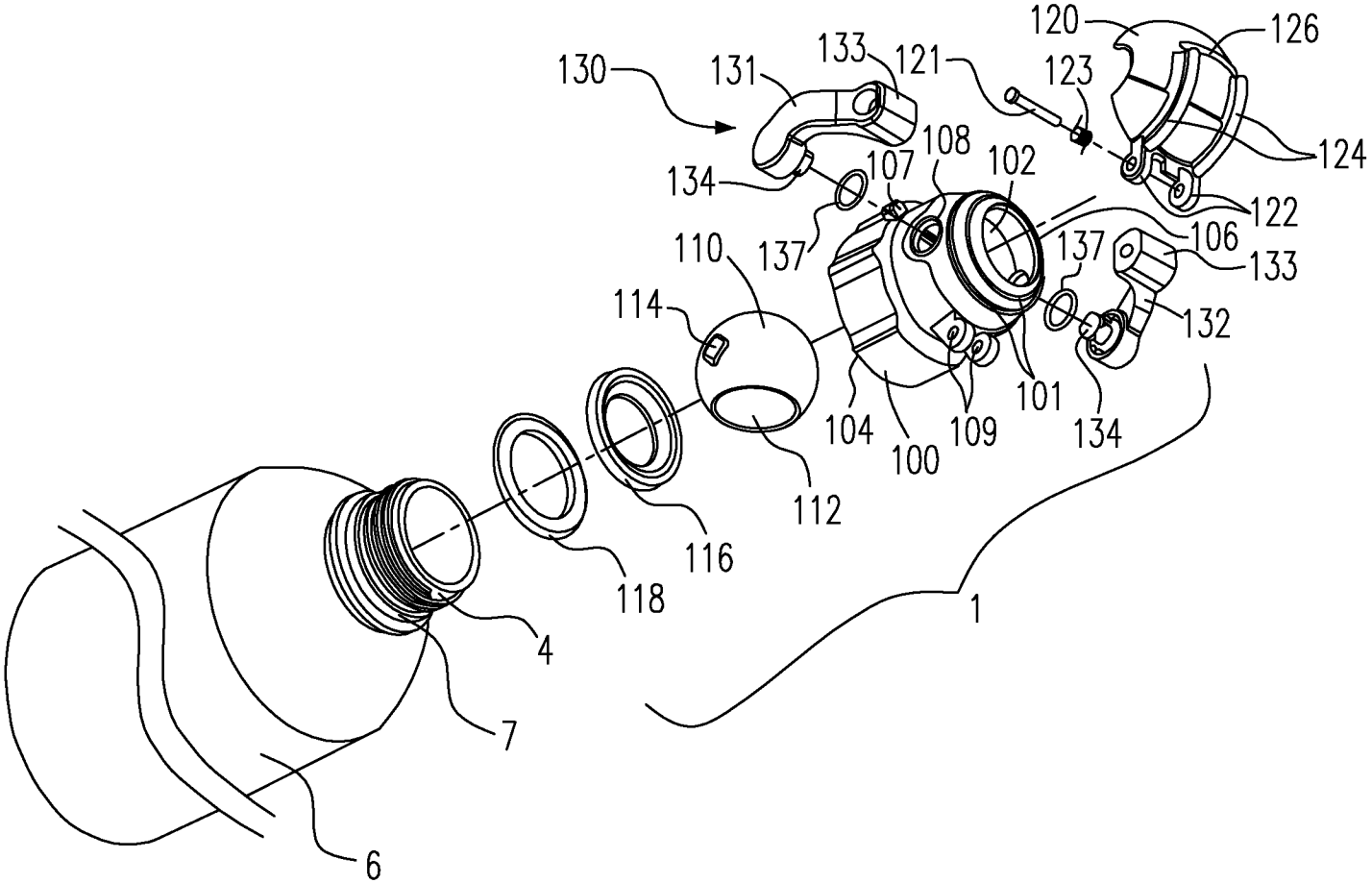
FIG. 1A is an exploded diagram of an improved flow control device according to an embodiment of the present invention from a top view.
Figure 1B:
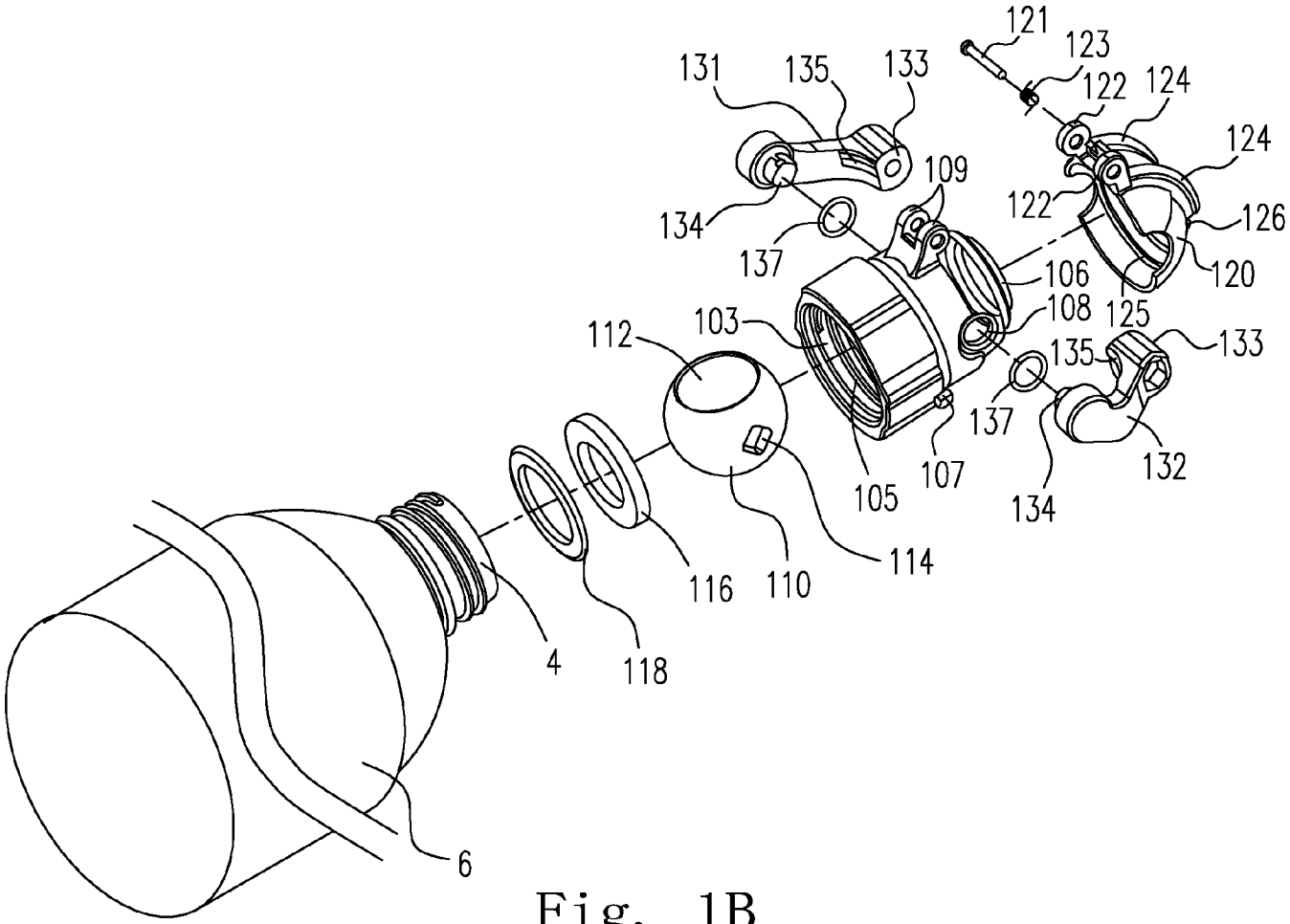
FIG. 1B is an exploded diagram of the improved flow control device of FIG. 1A from a bottom view.

As illustrated in FIGS. 1A and 1B, the improved flow control device 1 of the present invention mainly comprises an approximate hollow cylindrical body 100, a ball valve 110 contained in the containing space in a rotatable way, a hood 120 pivotally connected to the body 100, and a handle 130 operatively connected to the ball valve 110. In another embodiment, the ball valve can be generalized as a flow control member with a shape and design operatively coupled between the body 100 and the handle 130.

As illustrated in the figures, the body 100 includes a containing space 102 internally formed therein, an installing opening 104 fluidly communicating with the containing space, and a discharge opening 106 fluidly communicating with the containing space. An internal thread 105 is formed near the inner side of the installing opening 104 of the body 100 for being screwed and hitched on the bottle mouth 4 of the container 6 (such as a PET bottle, a glass bottle). There are two side holes 108 configured to be in radial correspondence with each other. In addition, two connecting lugs 109 are disposed on the outer wall of the body 100, and two stopping protrusions 107 are disposed near the lower part of the outer wall and substantially in radial correspondence with the two connecting lugs 109. Preferably, there is a plurality of convex rings 101 formed on the top of the outer wall of the body 100.

An axially penetrated flow passage 112 is disposed at the center of the ball valve 110, two engaging recesses 114 are disposed on the outer wall of the ball valve 110 and in radial correspondence with each other, and the imaginary interconnection axis between the two engaging recesses 114 are approximately perpendicular to the flow passage 112. In this embodiment, the two engaging recesses 114 have a square form, but in other embodiments, they can be in other form, such as ellipsoid, triangle, hexagon, or other regular or irregular polygon. In another embodiment, the skilled person should easily modify the aforementioned engaging recesses 114 into another engaging portion under the teaching and suggestion of the present invention. Such engaging portion can be either in a concave or convex structure. The ball valve 110 is disposed in a rotatable and sealed way in the containing space 102 of the body 100 by a washer component so that the ball valve 110 can be rotated more safely and smoothly, and water leakage of the flow control device can be further avoided. The washer component preferably includes a hard snap ring 116 (e.g. the Teflon O-ring) to effectively reduce the unwanted wear between the washer component and the ball valve 110 as compared to a soft ring, smooth the rotation movement and enhance the sealed degree of the flow control device. The washer component can further include a soft sealing ring 118 (e.g. the silicone or rubber O-ring) located on a bottom surface of the hard snap ring 116 and inserted into a groove of the inner wall of the body 100 for forming a sealed structure with the top of the container when the body 100 is screwed and hitched on the bottle mouth 4, thereby preventing the water leakage. As illustrated in the figures, the hard snap ring 116 preferably has an arc-shaped upper surface to match the approximate spherical shape of the ball valve 110. In addition, a groove 103 (FIG. 1B) is further formed near the inner wall of the installing opening 104 of the body 100 for matching the protrusion edge 7 of the bottle mouth 4 when the body is installed on the container 6 so as to fix the body 100 and prevent the body 100 from swinging after the body 100 is screwed on the bottle mouth 4 and, in the mean while, prevent the body 100 from being over screwed which causes the ball valve 110 to get stuck and fail to rotate.

As illustrated in the figures, a protective mechanism is provided and includes a protective member 120, a closing position, and an opening position, wherein the protective member 120 is coupled to the body 100 and the handle 130, and conceals the discharge opening 106 at the closing position to avoid water leakage owing to some irregular placements (e.g. the upside down placement, lain down placement) and/or movements (e.g. riding a bicycle, driving a car). In addition, the protective member 120 is decoupled to the handle 130 and reveals the discharge opening 106 at the opening position so that a user can drink directly with his mouth and without the obstruction of any other structural elements. Preferably, the protective member can be a hood and the hood is used in the embodiments for better describing the present invention, and hereinafter the hood is referred to as the hood 120. The hood 120 can have a shape matching to the shape of the top of the body 100, two connecting portions 122 are mounted thereon and in correspondence with the connecting lugs 109, and the hood 120 is pivotally connected to the body 100 by passing a pin 121 through the connecting lugs 109 and the connecting portions 122. A spring element 123, especially a bias spring or spiral spring, is mounted on the pin 121 to pivot the hood toward the opening position. A rib member is formed on the outer wall for stopping and engaging the handle 130, wherein the rib member includes a stopping rib 124 and an engaging rib 126 formed on the front end of the stopping rib 124. Preferably, a groove 125 is formed on the inner wall of the hood 120 in correspondence with the convex ring 101 of the top of the hood 120 so as to form a dust-proof and leak-proof sealed structure when the hood 120 is closed on the body 100.

In the embodiments illustrated in the figures, the handle 130 preferably includes a left handle 131 and a right handle 132, wherein each handle includes a connecting end 133 and an engaging end 134 so that a user can unload the handles 131 and 132 at will to facilitate the cleaning and washing procedures of the flow control device 1 as needed. In addition, the connecting ends 133 of the left handle 131 and the right handle 132 can connect each other by a fastener (not shown), such as screws and nuts, to form an operational part. The engaging end 134 has either a convex or concave structure to match the engaging portion of the ball valve 110. In these embodiments, the engaging end 134 is a square engaging lug. In addition, a notch 135 can be formed on the bottom surface of each connecting end 133, and the two notches 135 are joined together to form a single notch when the two connecting ends are joined together to be the operational part. In other embodiments, the handle 130 can be a single component, which includes an operational part, two engaging ends and a notch formed at the bottom of the operational part. In a preferable embodiment, the elements, such as the ball valve 110, protective member or hood 120, handle 130, washer component and the relevant elements of the flow control device 1 are dismountable, so that a user can unload those elements at will to facilitate the cleaning and washing procedures of the flow control device 1 as needed.

During the assembly stage, the ball valve 110 is put into the containing space 102 from the installing opening 104 of the body 100, and then the hard snap ring 116 is put into the body 100 from the installing opening 104. Next, the soft sealing ring 118 is inserted into the corresponding groove of the inner wall of the body 100 to install the ball valve 110 in a rotatable way in the containing space 102 of the body 100.

Next, the spiral bias spring 123 is disposed between the two connecting portions 122 of the hood 120, and the connecting portions 122 of the hood 120 and the bias spring 123 are aligned with the connecting lugs 109 of the body 100. Subsequently, the pin 121 is passed through them to pivotally connect the hood 120 to the body 100. At this time, the hood 120 can be pivoted to the opening position under the effect of the bias spring 123.

Figure 2A:
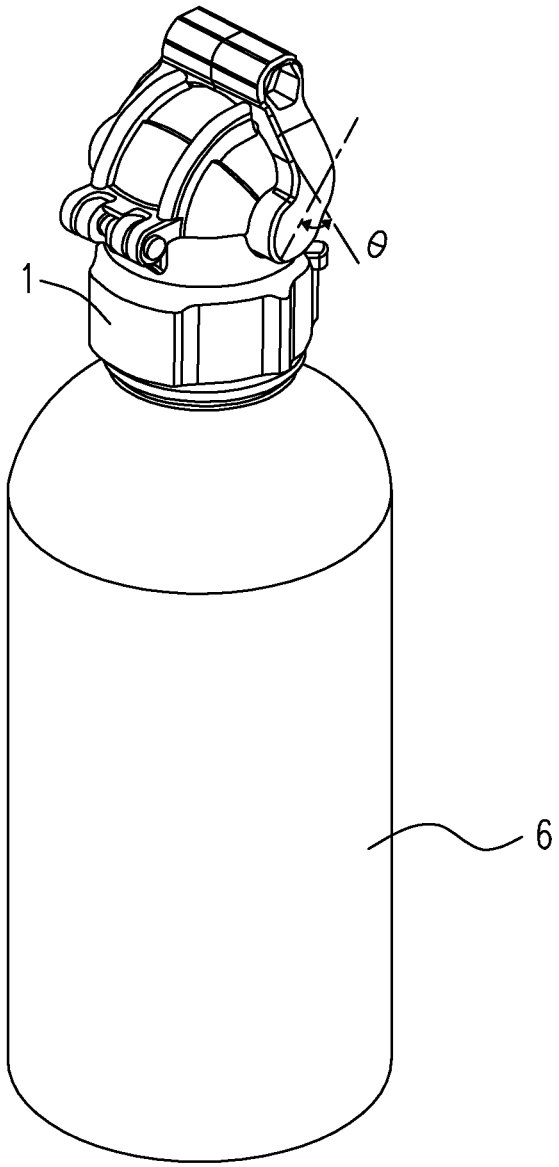
FIG. 2A shows the assembly of the improved flow control device of FIG. 1.
Figure 2B:
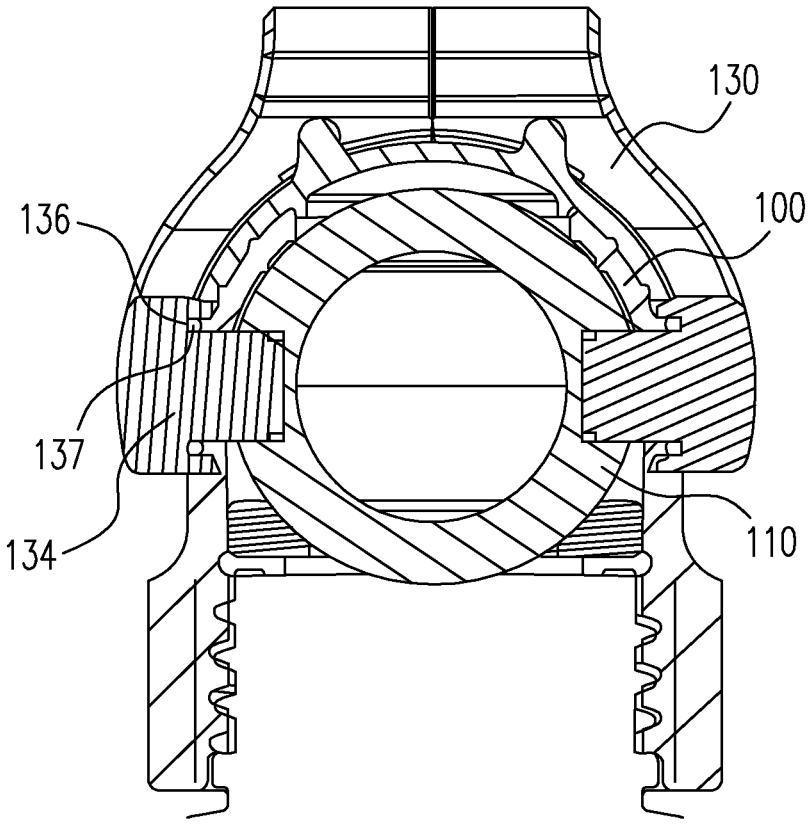
FIG. 2B is a cross-sectional view of FIG. 2A.
Figure 3A:
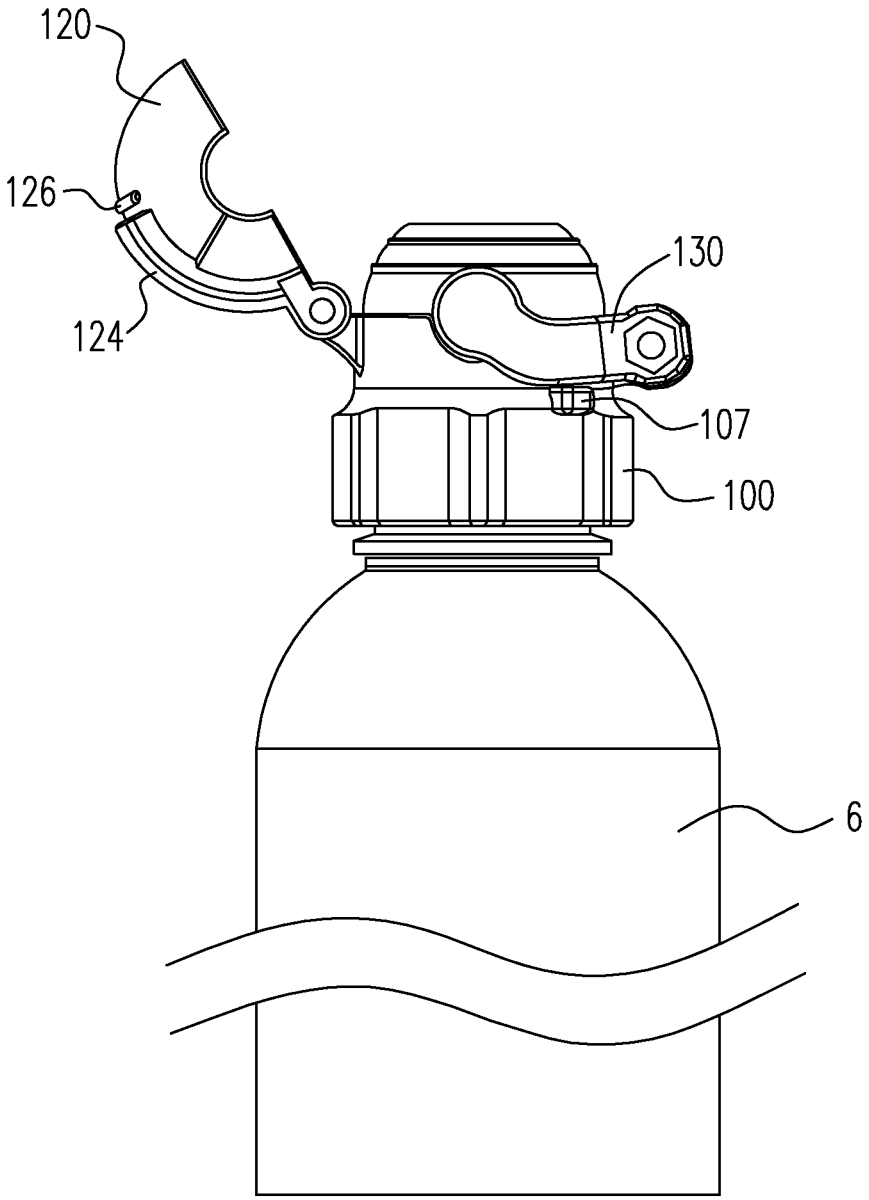
FIG. 3A shows an operation state of the improved flow control device of FIG. 1.

Next, the engaging ends 134 of the left and right handles 131, 132 of the handle 130 are separately engaged with the engaging recesses 114 of the ball valve 110 in the containing space 102 of the body 100 through the side holes 108, and the connecting ends of the left and right handles 131, 132 are joined together by a fastener (not shown) to form the handle 130. In these embodiments, the handle 130 and the ball valve 110 have a linked-movement connection, and the handle 130 can be pivoted with respect to the body 100, wherein the linked-movement relationship between the handle 130 and the ball valve 110 is so arranged that when the handle 130 is pivoted to the roughly horizontal (drawing position) with respect to the position of the body 100, the axially penetrated flow passage 112 of the ball valve 110 is aligned with the installing opening 104 and the discharge opening 106 of the body 100 (i.e. a flow passage is formed between the ball valve 110 and the body 100). When the handle 130 is pivoted to the vertical position (blocking position), the axially penetrated flow passage 112 of the ball valve 110 is 90 degrees with respect to the installing opening 104 and the discharge opening 106 of the body 100, so that the ball valve 110 tightly seals and blocks the discharge opening 106 (i.e. a flow passage cannot be formed between the ball valve 110 and the body 100). In other embodiments, the drawing position and the blocking position are not necessarily horizontal and vertical, and the angle between the flow passage 112 and the discharge opening 106 is not necessarily 90 degrees as long as they can match each other and function normally. Preferably, as illustrated in FIG. 2B, a groove 136 is formed at the bottom circumference of the engaging ends 134 of the left and right handles 131, 132, and an O-ring 137 is put therein. A protrusion edge is formed on each side hole 108 of the body 100 to form a sealed association between the engaging ends 134 and the side holes, thereby preventing water leakage from the inner of the flow control device 1 as well as dust, water, or other unwanted object penetration from the outer of the flow control device 1. FIG. 2A illustrates the well assembled improved flow control device 1 of the present invention in the blocking state. In addition, as illustrated in FIG. 2A, an angle θ preferably between 1 and 179 degrees is formed between the mean axis of the operational part and that of the engaging end 134 to ensure that there is an optimal linked-movement between the handle 130 and the ball valve 110 (and naturally, the stopping protrusion 107 and the engaging rib 126 should participate therein). Moreover, the angle θ can provide another advantage that it can lower the level of the operational part at the horizontal (or drawing) position as illustrated in FIG. 3A in order to avoid the user's mouth touching to the handle 130 as the user is drinking. Therefore, when a user cannot spare both of his hands when riding a bicycle, driving a car, or carrying an object, he can open or close the flow control device 1 more easily and smoothly by one hand and drink with less obstruction. More preferably, the angle θ is 45 degrees.

Subsequently, the operations of the improved flow control device of the present invention will be illustrated by referring to FIGS. 3A, 3B, 4A and 4B.

Figure 3B:
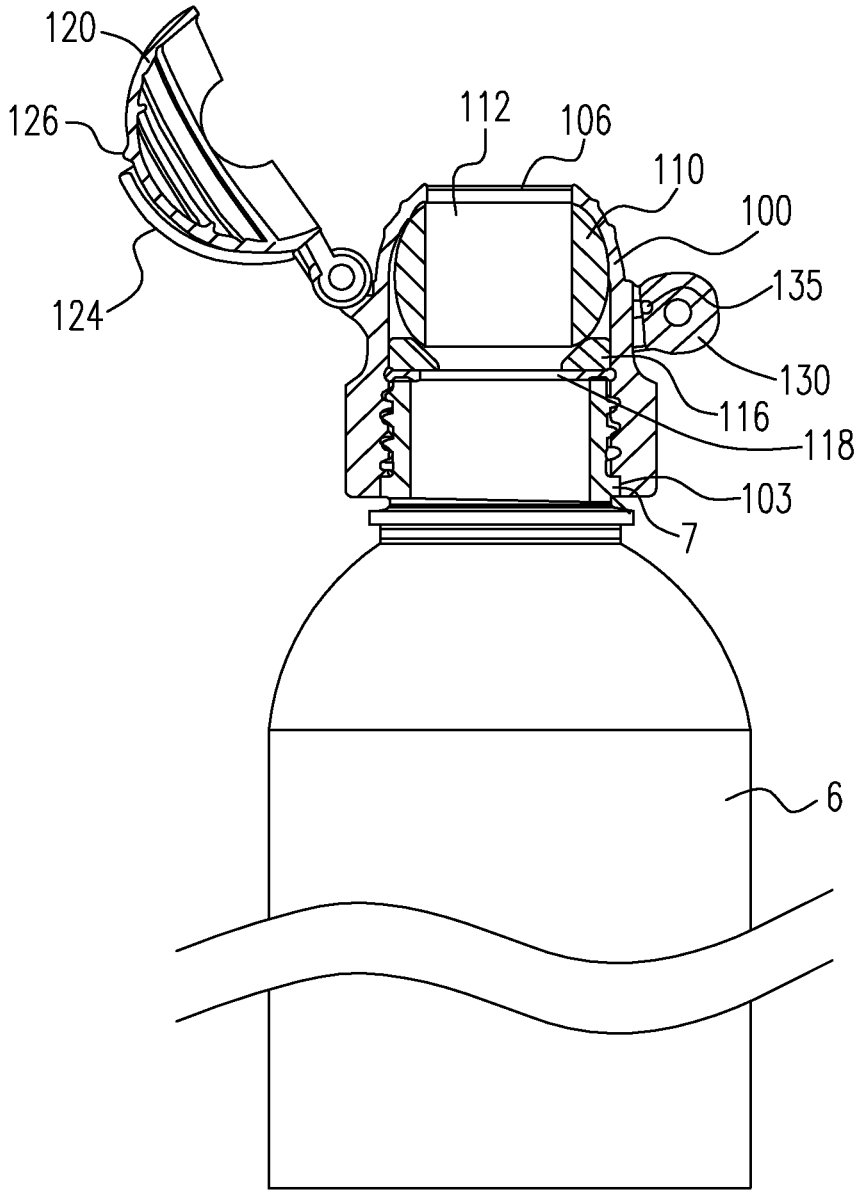
FIG. 3B is a cross-sectional view of FIG. 3A.
Figure 4A:
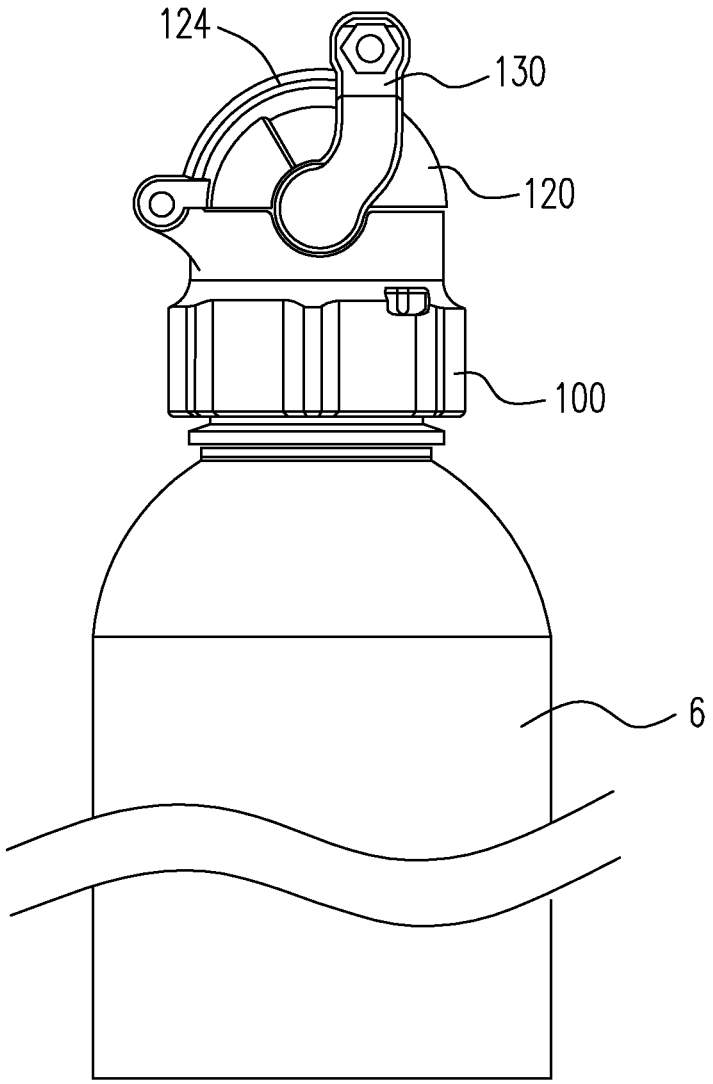
FIG. 4A shows another operation state of the improved flow control device of FIG. 1.

When the improved control device 1 of the present invention is in the blocking state of FIG. 2, the user only needs to pivot the handle 130 from the vertical position of FIG. 2 to the horizontal position of FIG. 3A by a single hand or even a single finger for aligning the axially penetrated flow passage 112 of the ball valve 110 with the installing opening 104 and the discharge opening 106 of the body 100 via the linked-movement relationship between the handle 130 and the ball valve 110, as illustrated in FIG. 4A. When the handle 130 is pivoted to the horizontal position of FIG. 3A, it is stopped at the horizontal position by the stopping protrusion 107 of the body 100 in order to keep the axially penetrated flow passage 112 of the ball valve 110 aligned with the discharge opening 106 and installing opening 104 of the body 100. At the same time, when the handle 130 is pivoted to the horizontal position of FIG. 3A, the hood 120 is automatically sprung up to the opening position as illustrated in FIGS. 3A and 3B due to the effect of the bias spring 123. At this time, the drink in the container can flow out of the container through the flow passage for the user to drink.

Figure 4B:
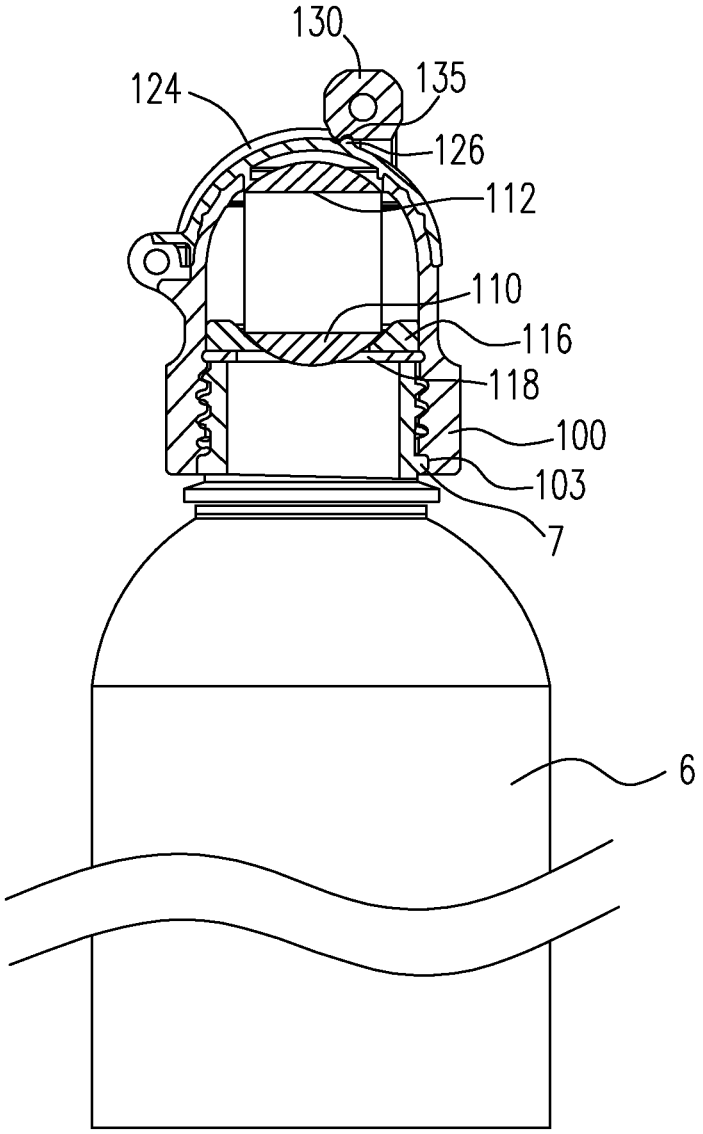
FIG. 4B is a cross-sectional view of FIG. 4A.

When there is still some unfinished drink in the container after the user's drinking, the user also only needs to press the hood 120 from the opening position back to the closing position by a single finger and then uses another single finger to pivot the handle 130 to the vertical position. At this time, the handle 130 is stopped at the vertical position by the stopping ribs 124, and the notch 135 of the connecting ends 133 of the handle 130 is engaged with the engaging rib 126 of the hood 120, thereby locking the hood 120 at the closing position and preventing the hood 120 from accidental bounce, as illustrated in FIG. 4A. In addition, when the handle 130 is pivoted from the horizontal position to the vertical position, the axially penetrated flow passage 112 of the ball valve 110 is jointly pivoted to be 90 degrees with respect to the installing opening 104 and the discharge opening 106 of the body 100, as illustrated in FIG. 4B, so that the drink in the container cannot flow out.

The present invention has at least the following advantages:

1. The present invention can effectively prevent the water leakage of the flow control device by the protective member or the hood 120, the washer component, the convex ring 101 and the groove 125, and the O-ring 137.

2. The present invention can effectively prevent the dust and other unwanted objects from contaminating the discharge opening 106 of the body 100 by the hood 120, the convex ring 101 and the groove 125, and the O-ring 137.

3. Through the engagement of the notch 135 of the connecting ends 133 of the handle 130 with the engaging rib 126 of the hood 120, the hood can be firmly locked at the closing position and cannot be opened accidentally. In addition, through the linked-movement connection of the handle 130 with the ball valve 110 of the body 100, the flow control of the improved flow control device 1 of the present invention can be implemented by operating the handle 130 with a single hand. That is, the handle 130 of the present invention can provide dual functions of controlling the discharge flow and locking the hood 120.

4. After opening the protective member or the hood 120 of the improved flow control device 1 of the present invention, the discharge opening 106 of the body 100 can be exposed without any covering of any other structural elements. Thus, it is convenient for the user to direct drink with his mouth.

5. Many main elements of the flow control device 1 are dismountable, such as the ball valve 110, the washer component, the handle 130, and the relevant elements thereof, so that a user can unload those elements at will to facilitate the cleaning and washing procedures of the flow control device 1 as needed.

6. When the body 100 is installed on the container 6, a groove 103 of the body 100 can match the protrusion edge 7 of the bottle mouth 4 and prevent the body 100 from swinging after screwed on the bottle mouth 4 and, in the mean while, prevent the body 100 from being over screwed which causes the ball valve 110 to get stuck and fail to rotate.

7. Through an angle θ formed between the mean axis of the operational part and the mean axis of the engaging end 134, the linked-movement between the handle 130 and the ball valve 110 can be optimized to smooth and facilitate the open or close behavior of the improved flow control device 1 of the present invention. In addition, the angle θ lowers the level of the operational part at the horizontal (or drawing) position to avoid the user's mouth touching to the handle 130 as the user is drinking.

Figure 5:
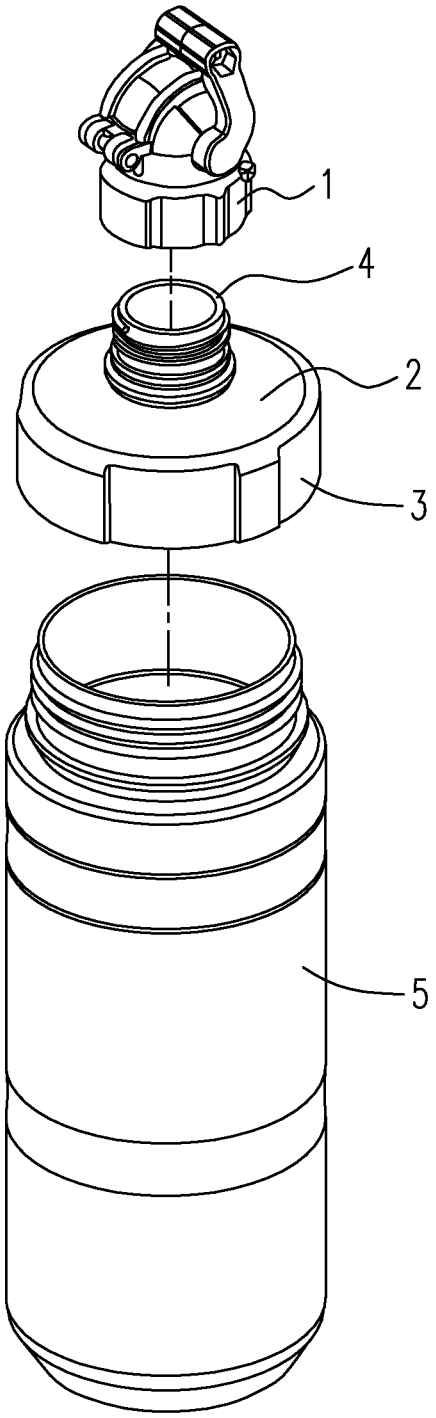
FIG. 5 is an exploded diagram of the improved flow control device according to another embodiment of the present invention.

Although the improved flow control device 1 of the present invention has been described by the embodiments preferable for a PET bottle that are illustrated in the aforementioned figures, it does not intended to be limited to the structures or operations disclosed therein. As a matter of fact, under the principles and spirits taught and suggested by the above, the present invention is capable of various modifications and transformations. For example, the flow control device can include a body 100 including a containing space 102, a discharge opening 106 fluidly communicating with the containing space 102, and a pair of side holes 108 configured to be in radial correspondence with each other; a flow control member 110 installed in the containing space 102 and including a pair of engaging portions 114 corresponding to the side holes 108; an adapter 2 including an adapting part 4 coupled to the body 100 and a hitching part 3 for being coupled to an external container 5; a washer 53 coupled to the adapting part 4 and inserted into the body 100 for installing the flow control member 110 in the containing space 102; and a handle 130 including an operational part, and a pair of engaging ends 134 coupled to the operational part and engaged with the engaging portions 114 through the side holes 108. This structure do produce some advantages, e.g. regulating the fluid flow from the external container 5, and smoothing the linked-movement of the flow control member 110, and preventing the water leakage. In an embodiment, as illustrated in FIG. 5, a bottle mouth adapter 2, which includes a hitching part 3 capable of being coupled with a different mouth bottle (e.g. a jar, a vacuum flask) and a bottle mouth part 4 capable of being screwed with the internal thread 105 of the body 100, is provided, so that the improved flow control device 1 of the present invention is well applicable to various containers. In other embodiments, the skilled person should reasonably apply the idea of the adapter 2 to couple the glass bottle, champagne bottle, or rice wine bottle, etc.

Figure 6A:
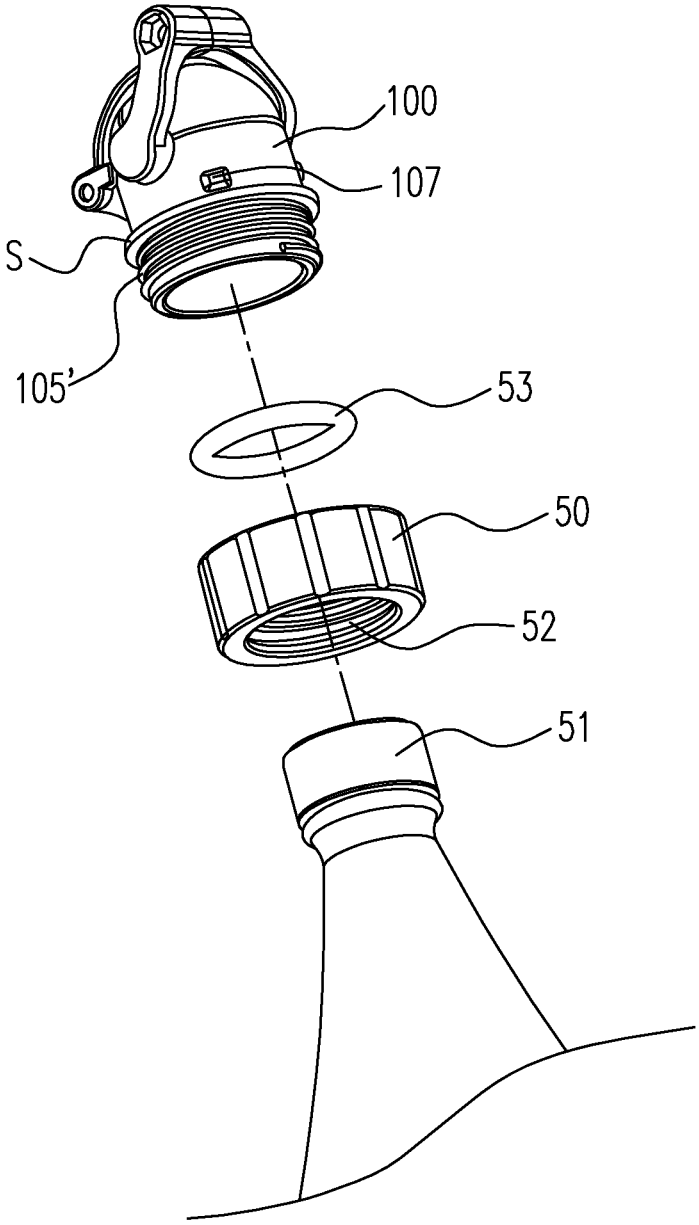
FIG. 6A is an exploded diagram of the improved flow control device according to a further embodiment of the present invention.
Figure 6B:
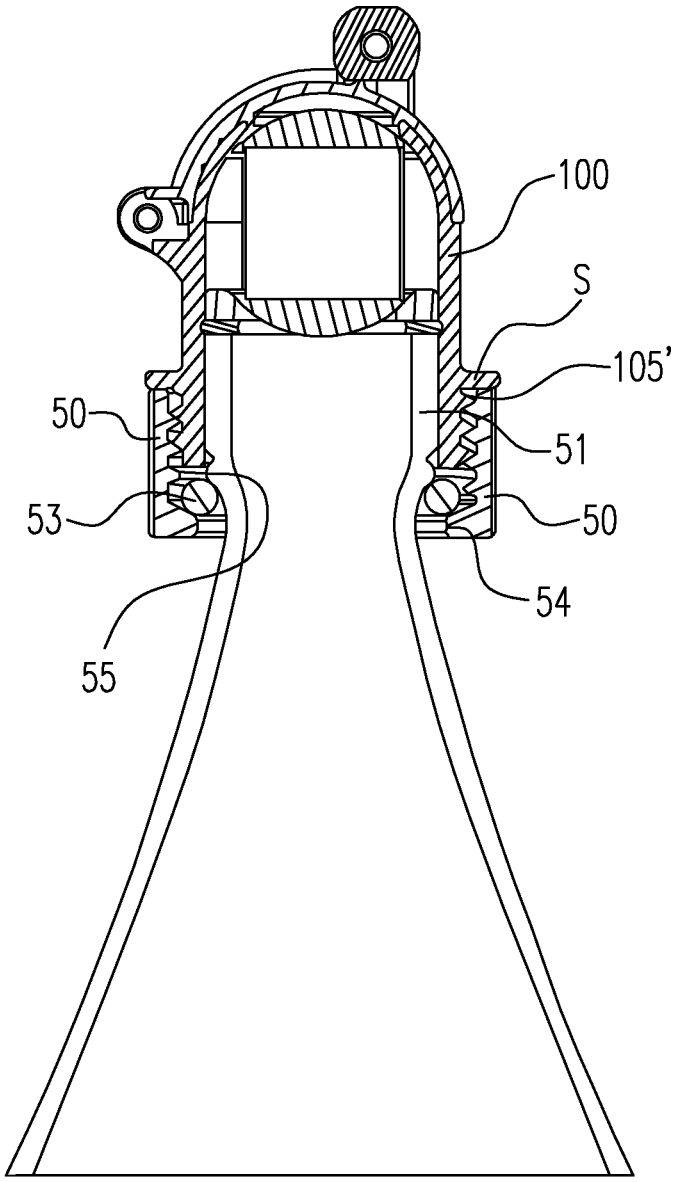
FIG. 6B is a cross-sectional view of the assembly of the improved flow control device of FIG. 6A.

In addition, to apply the improved flow control device 1 of the present invention to the container without the thread on the bottle mouth, such as the glass bottle, champagne bottle, or rice wine bottle, etc., the embodiments deduced from the same inventive concepts as the above are illustrated in FIGS. 6A and 6B. In these embodiments, the body of the flow control device includes a first body 100 including a first outer wall and an external thread 105' formed at the lower part of the first outer wall. Preferably, a stopping protrusion edge S is formed on the first outer wall of the first body 100 on the upper end of the external thread 105'. In addition, the body of the flow control device further includes a second body 50 (or a cylindrical ferrule in these embodiments) for hitching the bottle mouth 51 without the thread. The second body 50 includes a second inner wall, and an internal thread 52 (i.e. the internal thread 105) formed on the second inner wall to match the external thread 105'. A necking part 54 is formed at the bottom of the second body 50, and has a diameter smaller than that of the second body 50. Preferably, a flexible washer 53 is mounted in the necking part 54. Upon use, the necking part 54 of the second body 50 is hitched on the outer wall of the bottle mouth 51, the washer 53 is hitched on the bottle mouth 51, and the necking part 54 oppresses the washer 53 to abut on the protrusion edge portion 55 of the bottle mouth 51 to form a tight match. Next, the first body 100 is screwed with the second body 50, and the stopping protrusion edge S of the first body 100 contacts the upper end of the second body 50 to prevent the first body 100 and the second body 50 from being over screwed which causes the ball valve 110 to get stuck and fail to rotate. Therefore, the improved flow control device 1 of the present invention can be installed on the bottle mouth 51 without the thread, as illustrated in FIG. 6B.

Figure 7A:
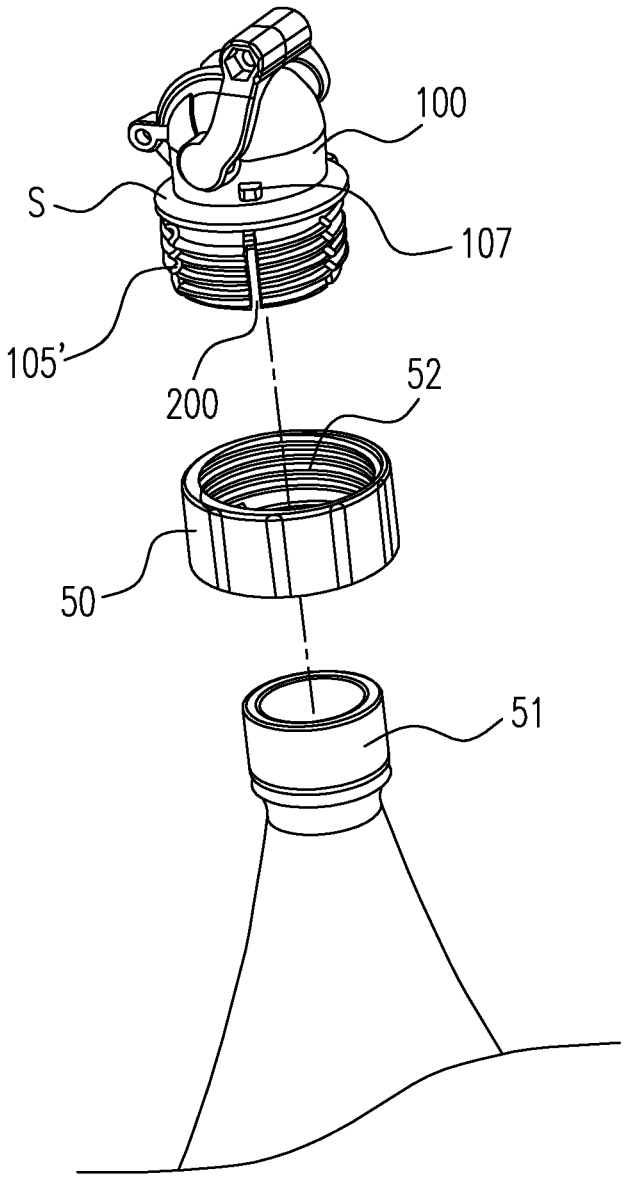
FIG. 7A is an exploded diagram of the improved flow control device according to further another embodiment of the present invention.
Figure 7B:
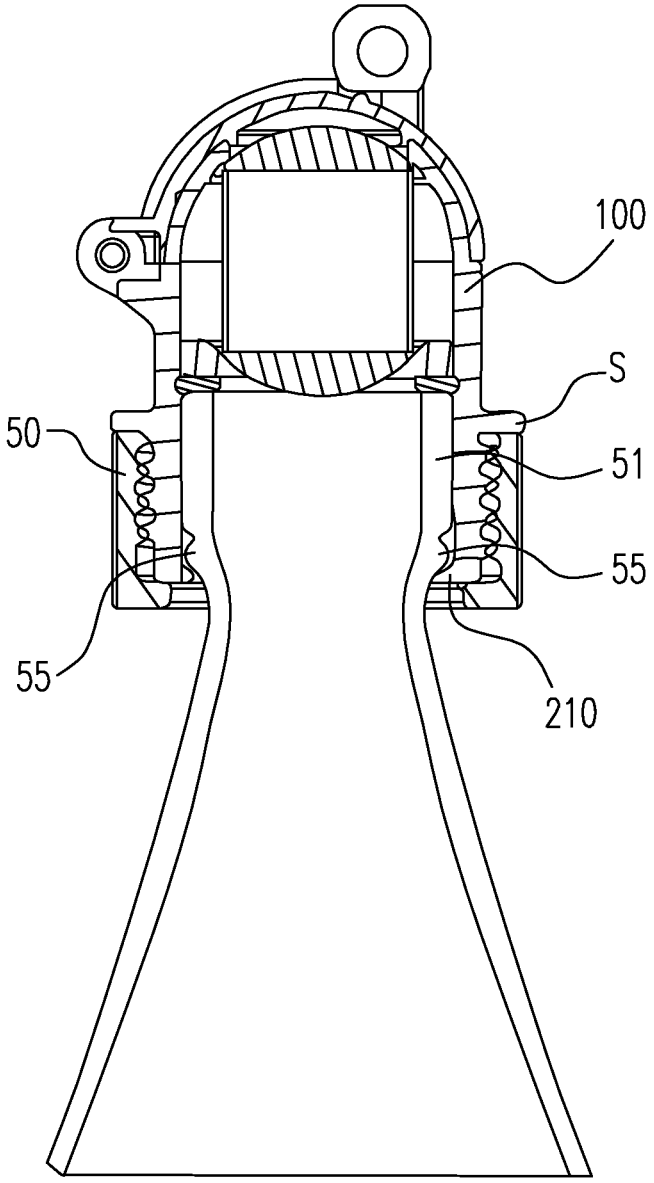
FIG. 7B is a cross-sectional view of the assembly of the improved flow control device of FIG. 7A.
Figure 8:
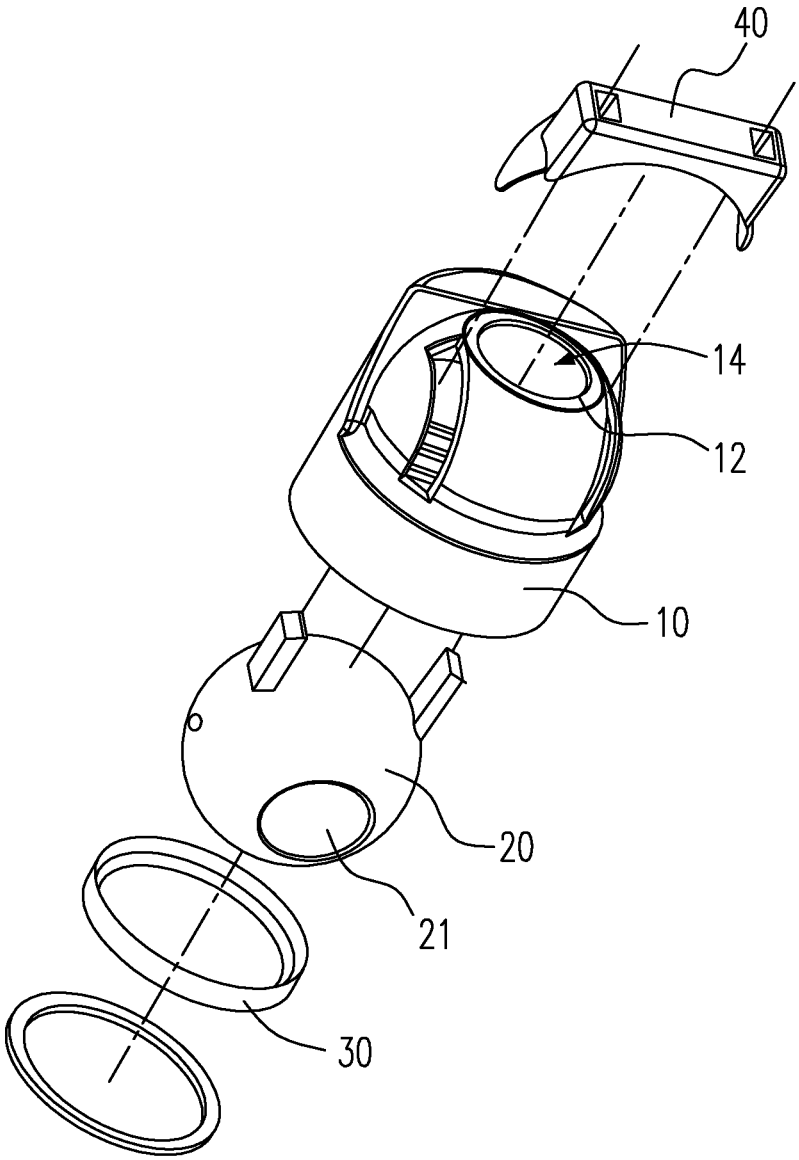
Fig. 8(Prior Art)
FIG. 8 is an exploded diagram of a conventional flow control device.

A modified structure of the above-mentioned embodiments is illustrated in FIGS. 7A and 7B. The differences between this modified structure and the above-mentioned embodiments are that a plurality of axial rabbets 200 are formed at the lower part of the first outer wall of the first body 100, and an inward projecting protrusion edge 210 is formed on the lower end of the first inner wall so that when the first body 100 and the second body are screwed together, the protrusion edge 210 can embrace the protrusion edge portion 55 of the bottle mouth 51 to form a tight match, as illustrated in FIG. 7B. In addition, because the first body 100 of this modified structure includes the protrusion edge 210 for tightly matching the protrusion edge portion 55, the flexible washer 53 can be omitted.

Embodiments

1. A flow control device, comprising:
   - a body including a containing space internally formed therein, an installing opening fluidly communicating with the containing space, a discharge opening fluidly communicating with the containing space, an internal thread formed near the installing opening, and at least a side hole;
   - a ball valve installed in the containing space and including a flow passage and at least an engaging recess;
   - a hood pivotally connected to the body to be rotatable between a closing position to cover the discharge opening and an opening position to expose the discharge opening; and
   - a handle including at least an engaging end engaged with the engaging recess through the side hole, by which the handle is pivotally mounted on the body to be rotatable between a drawing position and a blocking position, wherein when the handle is pivoted to the drawing position, the ball valve is rotated to align the flow passage with the installing opening and the discharge opening, and simultaneously the hood is pivoted to the opening position; and when the handle is pivoted to the blocking position, the ball valve is rotated to cause the flow passage to be misaligned with the installing opening and the discharge opening, and simultaneously the hood is restricted at the closing position.
2. A flow control device of Embodiment 1, further comprising another side hole, another engaging recess and another engaging end, wherein the two side holes are configured to be in radial correspondence with each other, and the two engaging recesses are configured to be in radial correspondence with each other, and the two engaging ends are respectively engaged with the two engaging recesses through the two side holes.
3. A flow control device of any one of Embodiments 1-2, wherein the body includes an inner wall and a groove configured on the inner wall, and the flow control device comprises a washer component inserted into the body for installing the ball valve in the containing space and including:
   - a hard snap ring having a bottom surface; and
   - a soft sealing ring located on the bottom surface of the hard snap ring and inserted into the groove.
4. A flow control device of any one of Embodiments 1-3, wherein the hood includes an outer wall and a rib member formed on the outer wall for stopping and engaging the handle.
5. A flow control device of any one of Embodiments 1-4, wherein the rib member includes a stopping rib having a front end and formed on the outer wall of the hood and an engaging rib formed on the front end, and the handle includes an operational part having a bottom, engaged with the engaging rib and stopped by the stopping rib when the handle is pivoted to the blocking position.

6. A flow control device of any one of Embodiments 1-5, wherein the handle further includes a notch formed at the bottom of the operational part for being engaged with the engaging rib when the hood is pivoted to the blocking position.
7. A flow control device of any one of Embodiments 1-6, wherein the body further includes a top and a convex ring formed on the top thereof, and the hood further includes a groove formed at a position thereof in correspondence with the convex ring.
8. A flow control device of any one of Embodiments 1-7, further comprising a pin, wherein the body further includes two connecting lugs, and the hood further includes two connecting portions and is pivotally connected to the body by passing the pin through the connecting lugs and the connecting portions.
9. A flow control device of any one of Embodiments 1-8, further comprising a bias spring mounted on the pin for automatically springing up the hood to the opening position as the handle is pivoted to the drawing position.
10. A flow control device of any one of Embodiments 1-9, wherein the body further includes at least a stopping protrusion stopping the handle when the handle is pivoted to the drawing position.
11. A flow control device of any one of Embodiments 1-10, wherein the handle includes a left handle and a right handle, each of which includes an engaging end and a connecting end, wherein the two connecting ends are connected to form an operational part.
12. A flow control device of any one of Embodiments 1-11, further comprising at least an O-ring formed between the engaging end and the side hole.
13. A flow control device of any one of Embodiments 1-12, further comprising a container, and a bottle mouth adapter including a hitching part coupled to the container and a bottle mouth part screwed with the internal thread.
14. A flow control device of any one of Embodiments 1-13, wherein the body includes:
    a first body including a first outer wall having a lower part, and an external thread formed on the lower part; and
    a second body including a second inner wall forming thereon the internal thread for matching the external thread.
15. A flow control device of any one of Embodiments 1-14, wherein the second body has a diameter and a bottom and further includes:
    a necking part formed on the bottom of the second body and having a diameter smaller than that of the second body; and
    a flexible washer mounted on the necking part.
16. A flow control device of any one of Embodiments 1-15, wherein the body includes:
    a first body including an external thread, a first outer wall having a lower part, and a plurality of axial rabbets formed on the lower part; and
    a second body including a second inner wall forming thereon the internal thread for matching the external thread.
17. A flow control device of any one of Embodiments 1-16, wherein the first body further includes a first inner wall having a lower part and an inward projecting protrusion edge formed on the lower part of the first inner wall.
18. A flow control device comprising:
    a body including a containing space, a discharge opening fluidly communicating with the containing space, and a pair of side holes configured to be in radial correspondence with each other;
    a flow control member installed in the containing space and including a pair of engaging portions corresponding to the side holes;
    an adapter including an adapting part coupled to the body and a hitching part for being coupled to an external container;
    a washer coupled to the adapting part and inserted into the body for installing the flow control member in the containing space; and
    a handle including an operational part, and a pair of engaging ends coupled to the operational part and engaged with the engaging portions through the side holes.
19. A flow control device of Embodiment 18, wherein the operational part has a first mean axis, and one of the engaging ends has a second mean axis, and an angle θ is formed between the first mean axis and the second mean axis in a range of 1 to 179 degrees.
20. A flow control device for controlling a fluid flow, comprising:
    a body including a containing space and a discharge opening fluidly communicating with the containing space;
    a handle pivotally mounted on the body and controlling the fluid flow from the body; and
    a protective mechanism including a protective member, a closing position and an opening position, wherein the protective member is coupled to the body and the handle and conceals the discharge opening at the closing position, and is decoupled to the handle and reveals the discharge opening at the opening position.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A flow control device, comprising:
    a body including a containing space internally formed therein, an installing opening fluidly communicating with the containing space, a discharge opening fluidly communicating with the containing space, an internal thread formed near the installing opening, and at least a side hole;
    a ball valve installed in the containing space and including a flow passage and at least an engaging recess;
    a hood pivotally connected to the body to be rotatable between a closing position to cover the discharge opening and an opening position to expose the discharge opening; and
    a handle including at least an engaging end engaged with the engaging recess through the side hole, by which the handle is pivotally mounted on the body to be rotatable between a drawing position and a blocking position, wherein when the handle is pivoted to the drawing position, the ball valve is rotated to align the flow passage with the installing opening and the discharge opening, and simultaneously the hood is pivoted to the opening position; and when the handle is pivoted to the blocking position, the ball valve is rotated to cause the flow passage to be misaligned with the installing opening and the discharge opening, and simultaneously the hood is restricted at the closing position.

2. A flow control device of claim 1, further comprising another side hole, another engaging recess and another engaging end, wherein the two side holes are configured to be in radial correspondence with each other, and the two engaging recesses are configured to be in radial correspondence with each other, and the two engaging ends are respectively engaged with the two engaging recesses through the two side holes.

3. A flow control device of any one of claim 1, wherein the body includes an inner wall and a groove configured on the inner wall, and the flow control device comprises a washer component inserted into the body for installing the ball valve in the containing space and including:

a hard snap ring having a bottom surface; and a soft sealing ring located on the bottom surface of the hard snap ring and inserted into the groove.

4. A flow control device of any one of claim 1, wherein the hood includes an outer wall and a rib member formed on the outer wall for stopping and engaging the handle.

5. A flow control device of any one of claim 4, wherein the rib member includes a stopping rib having a front end and formed on the outer wall of the hood and an engaging rib formed on the front end, and the handle includes an operational part having a bottom, engaged with the engaging rib and stopped by the stopping rib when the handle is pivoted to the blocking position.

6. A flow control device of any one of claim 5, wherein the handle further includes a notch formed at the bottom of the operational part for being engaged with the engaging rib when the hood is pivoted to the blocking position.

7. A flow control device of any one of claim 1, wherein the body further includes a top and a convex ring formed on the top thereof, and the hood further includes a groove formed at a position thereof in correspondence with the convex ring.

8. A flow control device of any one of claim 1, further comprising a pin, wherein the body further includes two connecting lugs, and the hood further includes two connecting portions and is pivotally connected to the body by passing the pin through the connecting lugs and the connecting portions.

9. A flow control device of any one of claim 8, further comprising a bias spring mounted on the pin for automatically springing up the hood to the opening position as the handle is pivoted to the drawing position.

10. A flow control device of any one of claim 1, wherein the body further includes at least a stopping protrusion stopping the handle when the handle is pivoted to the drawing position.

11. A flow control device of any one of claim 1, wherein the handle includes a left handle and a right handle, each of which includes an engaging end and a connecting end, wherein the two connecting ends are connected to form an operational part.

12. A flow control device of any one of claim 1, further comprising at least an O-ring formed between the engaging end and the side hole.

13. A flow control device for controlling a fluid flow, comprising:

a body including a containing space and a discharge opening fluidly communicating with the containing space;

a handle pivotally mounted on the body and controlling the fluid flow from the body, the handle pivotally moving between a first position and a second position, wherein the discharge opening fluidly communicates with the containing space when the handle is in the first position, and the discharge opening does not communicate with the containing space when the handle is in the second position; and a protective mechanism including a protective member, and operable to move between a closing position and an opening position, wherein when the protective member is in the closing position, the handle pivots to the second position to lock and clamp the protective member between the handle and the body so that the protective member conceals the discharge opening, and when the protective member is in the opening position, the handle is in the first position to unlock the protective member and the protective member reveals the discharge opening.

* * * * *